US006190820B1

(12) United States Patent
Patel et al.

(10) Patent No.: US 6,190,820 B1
(45) Date of Patent: Feb. 20, 2001

(54) TONER PROCESSES

(75) Inventors: Raj D. Patel, Oakville; Michael A. Hopper, Toronto; Walter Mychajlowskij, Mississauga, all of (CA)

(73) Assignee: Xerox Corporation, Stamford, CT (US)

( * ) Notice: Under 35 U.S.C. 154(b), the term of this patent shall be extended for 0 days.

(21) Appl. No.: 09/657,273

(22) Filed: Sep. 7, 2000

(51) Int. Cl.[7] ..... G03G 9/087
(52) U.S. Cl. ..... 430/137
(58) Field of Search ..... 430/137

(56) References Cited

U.S. PATENT DOCUMENTS

| | | | |
|---|---|---|---|
| 5,278,020 | 1/1994 | Grushkin et al. | 430/137 |
| 5,290,654 | 3/1994 | Sacripante et al. | 430/137 |
| 5,308,734 | 5/1994 | Sacripante et al. | 430/137 |
| 5,344,738 | 9/1994 | Kmiecik-Lawrynowicz et al. | 430/137 |
| 5,346,797 | 9/1994 | Kmiecik-Lawrynowicz et al. | 430/137 |
| 5,348,832 | 9/1994 | Sacripante et al. | 430/109 |
| 5,364,729 | 11/1994 | Kmiecik-Lawrynowicz et al. | 430/137 |
| 5,366,841 | 11/1994 | Patel et al. | 430/137 |
| 5,370,963 | 12/1994 | Patel et al. | 430/137 |
| 5,403,693 | 4/1995 | Patel et al. | 430/137 |
| 5,405,728 | 4/1995 | Hopper et al. | 430/137 |
| 5,418,108 | 5/1995 | Kmiecik-Lawrynowicz et al. | 430/137 |
| 5,482,812 | 1/1996 | Hopper et al. | 430/137 |
| 5,496,676 | 3/1996 | Croucher et al. | 430/137 |
| 5,501,935 | 3/1996 | Patel et al. | 430/137 |
| 5,527,658 | 6/1996 | Hopper et al. | 430/137 |
| 5,585,215 | 12/1996 | Ong et al. | 430/107 |
| 5,622,806 | 4/1997 | Veregin et al. | 430/137 |
| 5,650,255 | 7/1997 | Ng et al. | 430/137 |
| 5,650,256 | 7/1997 | Veregin et al. | 430/137 |
| 5,922,501 | 7/1999 | Cheng et al. | 430/137 |
| 5,945,245 | 8/1999 | Mychajlowskij et al. | 430/137 |
| 5,962,179 * | 10/1999 | Agur et al. | 430/137 |
| 6,120,967 * | 9/2000 | Hopper et al. | 430/137 |

* cited by examiner

*Primary Examiner*—Roland Martin
(74) *Attorney, Agent, or Firm*—E. O. Palazzo

(57) ABSTRACT

A process for the preparation of toner by, for example (i) generating by emulsion polymerization in the presence of an initiator a first resin latex emulsion;

(ii) generating in the presence of an oil soluble initiator by solution polymerization a second resin latex;

(iii) mixing (ii) with a colorant;

(iiib) mixing the resin latex emulsion of (i) with the resin/colorant mixture of (iii) to provide a blend of a resin and colorant;

(iv) adding an aqueous inorganic cationic coagulant solution of a metal salt and optionally an organic cationic coagulant to the resin/colorant blend of (iiib);

(v) heating at a temperature of from about 5° C. to about 10° C. below the resin Tg of (i), to form aggregate particles;

(vi) adjusting the pH of (v) by the addition of a base;

(vii) heating the aggregate particles of (v) at temperatures of from about 5° C. to about 50° C. above the Tg of the resin of (i), followed by the addition of an acid.

31 Claims, No Drawings

TONER PROCESSES

COPENDING APPLICATIONS

Illustrated in U.S. Ser. No. (not yet assigned—D/99677), "Surfactant free Toner Aggregation Process", filed concurrently herewith, the disclosure of which is totally incorporated herein by reference, is a process for the preparation of toner comprising: a process for the preparation of toner comprising: (i) generating by emulsion polymerization in the presence of an initiator a first resin latex emulsion; (ii) generating by polycondensation reaction a second resin latex in the presence of a catalyst; (iib) dispersing the resin of (ii) in warm water which is in the range of 50 95 degrees Centigrade and preferably in the range of 60 to 80 degrees Centigrade to provide a resin dispersion (iii) mixing (iib) with a colorant thereby providing a colorant dispersion; (iiib) mixing the resin latex emulsion of (I) with the resin/colorant mixture of (iii) to provide a blend of a resin and colorant; (iv) adding an aqueous inorganic cationic coagulant solution of a polymeric metal salt and optionally an organic cationic coagulant to the resin/colorant blend of (iiib); (v) heating at a temperature of from about 5 to about 10 degrees Centigrade below the resin Tg of (I), to thereby form aggregates particles and which particles are at a pH of form about 2 to about 3.5; (vi) adjusting the pH of (v) to about 6.5 to about 9 by the addition of a base; (vii) heating the aggregate particles of (v) at temperatures of from about 5 to about 50 degrees Centigrade above the Tg of the resin of (I), followed by a reduction of the pH to from about 2.5 to about 5 and preferably in the range of from about 3 to about 4.5 by the addition of an acid resulting in coalesced toner; (viii) optionally isolating the toner.

The appropriate components, reactants, process parameters, and the like of the above copending application may be selected for the present invention in embodiments thereof.

BACKGROUND OF THE INVENTION

The present invention relates to toner processes, and more specifically, to the preparation of a surfactant free latex wherein the resin particles contained therein are aggregated and coalesced with a colorant to provide toner compositions. More specifically, the present invention relates to a surfactant free toner process comprising (i) the preparation of an latex emulsion, containing submicron resin particles suspended in an aqueous phase, which phase is surfactant free, (ii) preparing a second resin which resin is readily dispersible in water to provide a dispersion of submicron particles in the diameter size range of, for example, about 50 to about 300 nanometers, and wherein the dispersion can be selected as a dispersant for the toner colorant particles thereby providing a stable colorant dispersion, followed by aggregation and coalescence with the latex emulsion of (i) to provide a toner composition. The resin (ii) utilized to stabilize the colorant, such as pigment particles is, for example, a styrene-butylacrylate-acrylic acid-4 styrene sulfonic acid, the sodium salt (sodium styrene sulfonate) or the like, and which resin is capable of self dispersing in warm water, for example from about 35° C. to about 85 degrees centigrade to provide a submicron particle size resin dispersion. Also, more specifically, the processes of the present invention can select dual coagulants such as an inorganic cationic metal salt and an organic cationic coagulant to, for example, facilitate aggregation of resin and colorant, such as pigment particles, both which can, for example, be in the size range of about 80 to about 4,000 nanometers and optionally a release agent such as a wax which can also be in the submicron diameter range and a charge control agent can be selected. With further respect to the processes of the present invention, there can be selected a staged increasing of the temperature during the coalescence wherein two or more temperature regions are selected to achieve the final coalescence followed by a staged changing of the pH of the aggregate mixture wherein the pH is lowered to, for example, provide toner process which are surfactant free.

PRIOR ART

Emulsion/aggregation/coalescing processes for the preparation of toners are illustrated in a number of Xerox patents, the disclosures of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797. Also of interest may be U.S. Pat. Nos. 5,348,832; 5,405,728; 5,366,841; 5,496,676; 5,527,658; 5,585,215; 5,650,255; 5,650,256 and 5,501,935.

In addition, the following U.S. Patents, the disclosures of which are incorporated herein by reference in their entireties, relate to processes for the preparation of toner compositions.

U.S. Pat. No. 5,922,501 illustrates a process for the preparation of toner comprising blending an aqueous colorant dispersion and a latex resin emulsion, and which latex resin can be generated from a dimeric acrylic acid, an oligomer acrylic acid, or mixtures thereof and a monomer; heating the resulting mixture at a temperature about equal, or about below the glass transition temperature (Tg) of the latex resin to form aggregates; heating the resulting aggregates at a temperature about equal to, or about above the Tg of the latex resin to effect coalescence and fusing of the aggregates; and optionally isolating the toner product, washing, and drying. U.S. Pat. No. 5,945,245 illustrates a surfactant free process for the preparation of toner comprising heating a mixture of an emulsion latex, a colorant, and an organic complexing agent.

U.S. Pat. No. 5,403,693 illustrates a process for the preparation of toner compositions with controlled particle size comprising (i) preparing a pigment dispersion in water, which dispersion is comprised of a pigment, an ionic surfactant in amounts of from about 0.5 to about 10 percent by weight of water, and an optional charge control agent; (ii) shearing the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant to control, prevent, or minimize further growth or enlargement of the particles in the coalescence step (iii); and (v) heating and coalescing from about 5 to about 50° C. above about the resin glass transition temperature, Tg, which resin Tg is, for example, from between about 45° C. to about 90° C. and preferably from between about 50° C. and about 80° C. the statically bound aggregated particles to form a toner composition comprised of resin, pigment and optional charge control agent.

U.S. Pat. No. 5,482,812 illustrates a process for the preparation of toner compositions or toner particles comprising (i) providing an aqueous pigment dispersion comprised of a pigment, an ionic surfactant, and optionally a charge control agent; (ii) providing a wax dispersion comprised of wax, a dispersant comprised of nonionic surfactant, ionic surfactant or mixtures thereof; (iii) shearing a mixture of the wax dispersion and the pigment dispersion with a latex or emulsion blend comprised of resin, a counterionic surfactant with a charge polarity of opposite sign to that of the ionic surfactant and a nonionic surfactant; (iv) heating the above sheared blend below about the glass transition temperature (Tg) of the resin to form electrostatically bound toner size aggregates; (v) adding additional ionic surfactant to the aggregated suspension of (iv) to ensure that no, or minimal additional particle growth of the electrostatically bound toner size aggregates occurs on further increasing the temperature to coalesce the aggregates into toner particles (vi); (vi) heating the mixture of (v) with bound aggregates above about or at the Tg of the resin; and optionally (vii) separating the toner particles from the aqueous slurry by filtration and thereafter optionally washing.

U.S. Pat. No. 5,622,806 illustrates a process for the preparation of toner compositions with controlled particle size comprising (i) preparing a pigment dispersion in water, which dispersion is comprised of a pigment, an ionic surfactant in amounts of from about 0.5 to about 10 percent by weight to water, and an optional charge control agent; (ii) shearing the pigment dispersion with a latex mixture comprised of a counterionic surfactant with a charge polarity of opposite sign to that of the ionic surfactant, a nonionic surfactant, and resin particles, thereby causing a flocculation or heterocoagulation of the formed particles of pigment, resin, and charge control agent; (iii) stirring the resulting sheared viscous mixture of (ii) at from about 300 to about 1,000 revolutions per minute to form electrostatically bound substantially stable toner size aggregates with a narrow particle size distribution; (iv) reducing the stirring speed in (iii) to from about 100 to about 600 revolutions per minute, and subsequently adding further anionic or nonionic surfactant in the range amount of from about 0.1 to about 10 percent by weight of water to control, prevent, or minimize further growth or enlargement of the particles in the coalescence (v); (v) heating and coalescing from about 5° C. to about 50° C. above about the resin glass transition temperature, Tg, which resin Tg is from between about 45° C. to about 90° C., the statically bound aggregated particles to form the toner composition comprised of resin, pigment and optional charge control agent; (vi) washing the aggregated particles at a temperature of from about 15° C. to about 5° C. below the glass transition temperature of the resin, and subsequently filtering the aggregated particles until substantially all of the surfactant has been removed from the aggregated particles, followed by subsequent drying of the particles at a temperature of from about 15° C. to about 5° C. below the glass transition temperature of the resin; and (vii) subsequently adding to the toner a first layer of a hydrophilic oxide, and a second layer of a hydrophobic oxide.

The appropriate components and processes of the above copending application and patents may be selected for the present invention in embodiments thereof.

SUMMARY OF THE INVENTION

It is a feature of the present invention to provide a surfactant free latex emulsion processes followed by the aggregation/coalescence of the latex with an aqueous dispersion of colorant particles comprised of submicron colorant particles which are stabilized by submicron resin, followed by the addition of a cationic coagulant or dual cationic coagulants during the homogenization or the blending to provide a toner composition.

It is a further feature of the present invention to provide a toner process that can be rapidly conducted, for example, for about 4 to about 6 hours and wherein only minimum washing of the toner particles is needed, such as about 1 to 2 washes and shorter coalescence times compared to many of the known toner surfactant processes; and processes wherein there is avoided the use of known commercial surfactants during the preparation of the latex emulsion, and which emulsion can be prepared by polymerizing monomers in the presence of a water soluble initiator where the process is considered an emulsion polymerization process, (ii) followed by the aggregation and coalescence of the resulting latex containing resin particles with a colorant in the presence of a cationic coagulant or dual coagulants to provide pigmented toner particles. An organic cationic coagulant is optionally utilized as a second coagulant in addition to the inorganic cationic metal salt coagulant, wherein the organic cationic coagulant acts as a charge passivating agent as illustrated in patent application U.S. Ser. No. 09/173,405 (D/98558), filed Oct. 15, 1998, "Toner Coagulant Processes", the disclosure of which is totally incorporated herein by reference, and further, the organic cationic coagulant can act as a charge enhancer and a coagulant wherein charge enhancer refers, for example, to providing an additional (4 to 6 microcoulombs/gram) toner charge attained compared to the charge of native particles. Furthermore, the organic cationic coagulant can facilitate rapid spheroidization of particles which is achieved, for example, in from about 1.5 to about 3 hours. Additionally, the coalescence of the formed aggregates can be conducted at staged pH changes, for example, primarily to prevent an increase in the toner particle size and the toner particle size distribution (GSD).

DESCRIPTION OF EMBODIMENTS

Aspects of the present invention relate to a process for the preparation of toner comprising (i) generating by emulsion polymerization in the presence of an initiator a first resin latex emulsion;

(ii) generating by solution polymerization in the presence of an oil soluble initiator a second resin latex;

(iii) mixing (ii) with a colorant thereby providing a colorant dispersion;

(iiib) mixing the resin latex emulsion of (i) with the resin/colorant mixture of (iii) to provide a blend of resin and colorant;

(iv) adding an inorganic cationic coagulant solution of a metal salt, or an organic cationic coagulant, or mixtures thereof to the resin/colorant blend of (iiib);

(v) heating at a temperature of from about 5° C. to about 10° C. below the latex resin Tg of (i), to form aggregate particles and which particles are at a pH of from about 2 to about 4;

(vi) adjusting the pH of (v) to about 6.5 to about 9 by the addition of a base;

(vii) heating the aggregate particles at a temperature of from about 5° C. to about 50° C. above the Tg of the latex resin of (i), followed by a reduction of the pH to from about 2.5 to about 5 by the addition of an acid thereby resulting in coalesced toner; and (viii) optionally but preferably isolating the toner; a process wherein subsequent to (vi) there is added an additional latex containing a resin generated by emulsion polymerization; a process wherein subsequent to the addition of the latex there is formed a coating on the aggregates of (v); a process (ii) wherein the resulting resin (ii) is dispersed in warm water resulting in a resin dispersion which dispersion is then added to the colorant, and mixed thereby providing a colorant dispersion; a process wherein (iv) is accomplished by stirring and then subjecting the blend to high shear to form a homogeneous gel; a process wherein the toner is isolated, and optionally washed and dried, and wherein the toner is comprised of resin and colorant;

a process for the preparation of a toner comprising (i) generating by emulsion polymerization in the presence of an initiator a latex emulsion containing a first resin;

(ii) generating by solution polymerization a second resin, and wherein the resulting resin is dispersed in warm water to provide a dispersion of the second resin;

(iii) mixing (ii) and a colorant wherein there is formed a coating of resin (ii) on the colorant thereby providing a stable colorant dispersion and wherein optionally from about 70 to about 95 percent of colorant is coated by the resin;

(iv) blending the resin latex emulsion of (i) with the colorant/resin dispersion (iii) to form a resin latex/colorant blend;

(v) adding an aqueous inorganic cationic coagulant solution of a metal salt and an organic cationic coagulant or mixtures thereof to the resin latex/colorant blend (iv), while optionally continuously subjecting the blend to high shear to optionally induce the formation of a homogeneous gel of the resin/colorant blend;

(vi) heating the sheared gel of (v) at a temperature of from about 5° C. to about 10° C. below the latex resin (i) glass transition temperature while continuously stirring to form aggregates particles of resin, coagulant and colorant;

(vii) optionally retaining (vi) for an optional period of from about 1 to about 3 hours to primarily minimize growth of the aggregates and optionally achieve a narrow GSD of from about 1.15 to about 1.24;

(viii) optionally adding a further latex comprised of resin(i), wherein the addition of the latex enables the formation of a coating on the aggregates of (vii);

(ix) changing the pH of the aggregates of (vii) which is initially in the range of from about 2 to about 3.5 to a pH in the range of about 6.5 to about 9 by the addition of a base to thereby primarily stabilize the aggregate particles from further growth;

(x) heating the aggregate particles of (ix) at temperatures of from about 5 to about 50° C. above the Tg of the resin (i), followed by a reduction of the pH from the range of about 6.5 to about 9.0 to a pH range of about 2.5 to about 5 with an acid to form coalesced particles of a toner composition of resin (i), resin (ii), resin (viii) and colorant; and (xi) optionally separating and drying the toner; a process wherein the resin (i) is submicron in size and wherein the submicron is from about 50 to about 250 nanometers in diameter; the warm is from about 60° C. to about 80° C.; the resin of (ii) is dispersed in warm water resulting in a resin dispersion with resin particle size in the range of about 30 to about 120 nanometers in diameter and wherein the dispersion of (ii) is selected as dispersant for the colorant particles to provide a stable colorant dispersion by grinding the colorant particles in the resin dispersion (ii) resulting in a colorant dispersion comprising colorant particles with a resin coating in water, and wherein the coating thickness of the second resin (iii) is from about 10 to about 120 nanometers, the coating thickness of the additional latex resin (viii) after the formation of the aggregates is in the range of from about 0.1 (100 nanometers) to about 1 (1,000 nanometers) micron; and wherein the components of the final toner are comprised of (a) a resin latex of (i), (b) resin (ii), (c) resin (viii), and (d) colorant, with the following optional amount ranges of (a) about 53.5 to about 65.6 percent;

(b) about 4 to about 15 percent;

(c) about 0.4 to about 1.5 percent;

(d) from about 1 to about 15 percent, and wherein the total of the toner components (a) to (d) is about 100 percent; a process wherein the latex of (i) comprises submicron resin particles of styrene, butylacrylate, and sodium styrene sulfonate, which sulfonate optionally functions as a dispersant for the resin, thereby providing a stable latex; a process wherein the pH during the blending and the aggregation (iv) to (viii) is in the range of about 1.8 to about 4.5; a process (iv) to (vi), wherein the pH is acidic and the pH is the range of from about 1.8 to about 4 enabling a narrow particle size distribution for the toner aggregates of (vi), and wherein the size distribution thereof is in the range of from about 1.16 to about 1.24; a process wherein the latex (vii) is comprised of the same polymer resin composition as that of (i) or a different polymer composition than that of (i) and/or a polymer with different molecular properties of weight average molecular weight, number molecular number, molecular weight distribution, and glass transition temperature (Tg) than that of (i), thereby providing a toner core shell structure; a process wherein the second resin (ii) prepared by solution polymerization provides a resin which is dispersible in warm water wherein the temperature of the water is in the range of form about 60 to about 80° C. thereby providing a stable emulsion containing water and submicron size resin particles which are in the size range diameter of from about 0.03 to about 0.12 microns; a process wherein the inorganic cationic coagulant is selected from the group consisting of metal sulfates, metal nitrates, and metal chlorides; a process wherein the coagulant is aluminum sulfate, magnesium sulfate, zinc sulfate, potassium aluminum sulfate, calcium acetate, calcium chloride, calcium nitrate, zinc acetate, zinc nitrate, or aluminum chloride; a process wherein the organic cationic coagulant is an organic salt of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, or dodecylbenzyl triethyl ammonium chloride; a process wherein (iv), further includes adding a wax dispersion, comprised of submicron wax particles in the diameter size range of about 80 to about 200 nanometers, which are optionally stabilized by the resin of (ii), and wherein the wax particles contain a coating of the resin of (ii); a process wherein the wax is selected from the group consisting of polyethylene, polypropylene, polyethylene/amide, polyethylene tetrafluoroethylene, and polyethylene tertrafluorethylene/amide; a process where the wax is comprised of submicron wax particles in the size range of 80 to 200 nanometers; a process wherein the second resin (ii) is prepared in the presence of an organic initiator and wherein the is selected from a group consisting of a terpolymer of styrene butylacrylate 4-styrene sulfonic acid sodium salt, styrene butylacrylate-4-styrene phosphoric acid sodium salt and styrene acrylic acid polymers; a process wherein the latex of (i) contains in resin selected from a group consisting of poly(styrene-acrylate), poly(styrene-butadiene), poly(para-methyl styrene-butadiene), poly(meta-methyl styrene-butadiene), poly(alpha-methylstyrene-butadiene), poly(methyl methacrylate-butadiene), poly(ethylmethacrylate-butadiene), poly(propyl methacrylate-butadiene), poly(butylmethacrylate-butadiene), poly (methylacrylate-butadiene ), poly(ethylacrylate-butadiene), poly(propylacrylate-butadiene), poly (butylacrylate-butadiene), poly(styrene-isoprene), poly(para-methyl styrene-isoprene), poly(meta-methyl styrene-isoprene), poly(alpha-methylstyrene-isoprene), poly (methylmethacrylate-isoprene), poly (ethylmethacrylate-isoprene), poly (propylmethacrylate-isoprene), poly (butylmethacrylate-isoprene), poly (methylacrylate-isoprene), poly(ethylacrylate-isoprene), poly(propylacrylate-isoprene), and poly (butylacrylate-isoprene) copolymers; a process wherein the heating in (vi) is at a temperature of from 5° C. to 10° C. below the glass transition temperature (Tg) of the latex emulsion resin of (i), further including stirring the mixture resulting at speeds of about 200 and about 800 rpm to form aggregates of a diameter of from about 3 to about 10 microns with a narrow GSD in the range of from about 1.10 to about 1.25, or wherein the heating in (x) is conducted at a temperature of from about 5° C. to about 50° C. above the glass transition temperature (Tg) of the resin of (i) to form a toner comprised of styrene-butylacrylate-sodium styrene sulfonate and a colorant in the size range of about 3 to about 10 microns wherein the latex resin dispersion of (i) contains submicron resin particles having an average size diameter of about 250 nanometers or less, wherein the high shear in (v) is from 3,000 to 10,0000 rpm for 1 to about 120 minutes; the high (v) is performed by a homogenizer, or a microfluidizer; a process wherein the resin dispersion particle size of the resin of (ii) which resin is water dispersible is in the range of about 30 to about 120 nanometers; a process wherein the toner obtained possess an average volume diameter of from about 1 to about 20 microns; a process wherein for the preparation of the latex (i) the initiator is ammonium persulfate, potassium persulfate, sodium persulfate, ammonium persulfite, potassium persulfite, sodium persulfite, ammonium bisulfate, potassium bisulfate, sodium bisulfate, 1,1'-azobis (I-methylbutyronitrile-3-sodium sulfonate, or 4,4'-azobis(4-cyanovaleric), and which initiator is selected in the amount of about 0.1 to about 10 weight percent of the monomer to be polymerized, and wherein the oil soluble initiator for the preparation of the second latex (ii) is hydrogen peroxide, t-butyl hydroperoxide, cumene hydroperoxide, para-methane hydroperoxide, benzoyl peroxide, tert-butyl peroxide, cumyl peroxide, 2,2'-azobisisobutyronitrile, 2,2'-azobis (2-methyl-butyonitrile, 2,2'-azobis(2-amindino propane)dihydrochloride, 2,2-azobisisobutyl amide dihydrate, 2,2'-azobis[2-(2-imidazoline-2-yl) propane]dihydrochloride, and which initiator is present in an amount of about 0.1 to 10 weight percent of the monomer to be polymerized in (ii); a process wherein the resin or resins of (ii) forms a coating on the colorant particles thereby providing a stable colorant; a process wherein an organic cationic is present; a process wherein the inorganic cationic coagulant is selected from the group consisting of metal sulfates, metal nitrates, and metal chlorides; and the organic cationic coagulant is an organic salt of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, or dodecylbenzyl triethyl ammonium chloride; a toner process which comprises mixing a colorant dispersion, a resin latex (i), a resin latex (ii), and an inorganic coagulant, an organic cationic coagulant, and mixtures thereof; heating below the resin latex (i) glass transition temperature; heating above the latex resin (i) glass transition temperature; a process wherein (i) is generated by emulsion polymerization, (ii) is generated by solution polymerization; the heating below is accomplished at a pH of from about 2 to about 4, and the resin of (ii) forms a shell or coating on the resin (i), and the colorant; a process for the preparation of a toner composition comprising forming by emulsion polymerization in the presence of an initiator a resin latex dispersion in the size diameter range of about 50 to about 250 nanometers; (ii) preparing a second resin by solution polymerization and wherein the resin resulting is dispersed in warm water which warm is at a temperature of from about 60° C. to about 80° C. to provide submicron of from about 0.03 to about 0.12 microns or nanometers resin dispersion; (iii) wherein the dispersion of (ii) is then utilized to stabilize pigment particles resulting in a pigment dispersion; (iv) blending the resin latex dispersion with the pigment dispersion, to form a resin-pigment blend; (v) adding an aqueous inorganic cationic coagulant solution of a metal salt and optionally an organic cationic coagulant to the resin-pigment blend while continuously subjecting the blend to high shear, to induce a homogeneous gel of the resin-pigment blend; (vi) heating the sheared gel at temperature of 5° C. to 10° C. below the resin glass transition temperature (Tg) while continuously stirring to form aggregates particles; (vii) following a period of 1 to 3 hours of aggregation time to permit stabilization of the aggregate particle size and achieve a narrow GSD which is <1.24; (viii) optionally adding the delayed or second latex, followed by; (ix) changing the pH of the mixture of (viii), which is in range of about 2 to about 3 to about 6.5 to about 9 with a base to stabilize the aggregate particles from further growth; heating the aggregate particles at temperatures of 5° C. to 50° C. above the Tg of the resin, for a period of 0.5 to 1 hour, followed by a reduction of the pH from the range of 6.5 to 9 to about 2.5 to 5 and preferably to 3 to 4.5 with an acid to form coalesced particles of a toner composition with a smooth surface; separating and drying the toner; a process for the preparation of toner comprising generating by emulsion polymerization in the presence of an oil initiator a first resin latex emulsion; (ii) generating by solution polymerization a second resin latex; (iii) mixing (ii) with a colorant thereby providing a colorant dispersion; (iiib) mixing the resin latex emulsion of (i) with resin/colorant mixture of (iii) to provide a blend of a resin and colorant; (iv) adding an aqueous inorganic cationic coagulant solution of a metal salt and an organic cationic coagulant to the resin/colorant blend of (iiib); (v) heating to thereby form aggregates particles; (vi) adjusting the pH of the mixture of (v) to from about 6.5 to about 9 by the addition of a base; (vii) heating the aggregate particles of (v) at temperatures above the Tg of the resin of (i), followed by a reduction of the pH to from about 2.5 to about 5 by the addition of an acid resulting in coalesced toner; (viii) isolating the toner; a process wherein the pH in (vii) is from about 3 to about 4.5; a process for the preparation of toner comprising (i) generating by emulsion polymerization in the presence of an initiator a first resin latex emulsion;

(ii) generating by solution polymerization a second resin latex in the presence of an oil soluble initiator;

(iii) mixing (ii) with a colorant thereby providing a colorant dispersion;

(iiib) mixing the resin latex emulsion of (i) with the resin/colorant mixture of (iii) to provide a blend of a resin and colorant;

(iv) adding an aqueous inorganic cationic coagulant solution of a metal salt and optionally an organic cationic coagulant to the resin/colorant blend of (iiib);

(v) heating at a temperature of from about 5° C. to about 10° C. below the resin Tg of (i), to form aggregate particles and which particles are at a pH of from about 2 to about 3.5;

(vi) adjusting the pH of (v) to about 6.5 to about 9 by the addition of a base;

(vii) heating the aggregate particles of (v) at temperatures of from about 5° C. to about 50° C. above the Tg of the resin of (i), followed by a reduction of the pH to from about 2.5 to about 5 by the addition of an acid thereby resulting in coalesced toner; and (viii) isolating the toner; a process for the preparation of a toner composition comprising (i) forming a first resin latex emulsion of submicron resin particles in the absence of an ionic or an emulsion polymerization nonionic surfactant; (ii) preparing a second resin wherein the resin is dispersible in warm water to provide a submicron resin dispersion, or a self dispersing resin; (iii) wherein the dispersion of (ii) is then selected as a colorant dispersant thereby providing a coating or a shell on the resin and colorant by using grinding mills; (iv) blending the resin latex emulsion of (i) with the colorant dispersion of (iii) above, to form a resin-colorant blend; (v) adding an aqueous coagulant solution to the resin-colorant blend, while continuously subjecting the blend to high shear, to form a homogeneous mixture of a resin-colorant blend; (vi) heating the resulting sheared gel at temperature below the resin glass transition temperature (Tg) while continuously stirring to form aggregates particles; (vii) permitting a period of about 1 to about 3 hours of aggregation time to enable stabilization of the aggregate particle size; (viii) optionally adding the resin latex emulsion of (i) to the mixture of the aggregate particles (vi); (ix) changing the pH of the mixture from about −2.4 to greater than about 6 and preferably in the range of about 6.5 to about 9 with a base to stabilize the aggregates wherein the increase in the pH assists in retaining the aggregate particle size and the particle size distribution; (x) heating the aggregate particles at temperatures above the Tg of the resin, followed by a reduction of the pH to from about 8 to about 2.5 to about 5.5 and preferably to about 3 to about 5 with an acid to form coalesced particles of a toner composition with a smooth surface, that is for example the particles are almost spherical in morphology the advantages of such particles being their clean capability during development, less additives usage during dry blending, stable charge over a period of time in the developer hosing, and better mechanical integrity of the toner particles in the developer housing; and (xi) separating the particles by, for example, filtration, centrifugation or other known processes and drying the particles by, for example, freeze drying, fluid bed drying or spray drying; (i) forming a resin latex emulsion of submicron less than about 1 micron in diameter resin particles in the absence of ionic or nonionic surfactants; (ii) preparing a second resin by solution polymerization wherein the resulting resin is then dispersed in water to provide a resin dispersion; (iii) utilizing the dispersion of (ii) to stabilize the toner colorant particles; (iv) blending the resin latex emulsion of (i) with the colorant (iii), to form a resin-colorant blend; (v) adding an aqueous inorganic cationic coagulant solution of a metal salt the resin-pigment blend, while continuously subjecting the blend to high shear, to induce a homogeneous gel of the resin/colorant blend; (vi) heating the sheared gel at temperature of 5° C. to 10° C. below the resin glass transition temperature (Tg) while continuously stirring to form aggregate particles; (vii) following a period of aggregation time to permit stabilization of aggregate particle size; (viii) optionally adding the above latex emulsion (i) a latex with different composition components and or dissimilar molecular properties to the mixture of the aggregate particles to provide a layer (ix); changing the pH of the mixture which is initially about 2 to 3 to greater than 6 and preferably changing the pH to about 6.5 to about 9.0 with a base to stabilize the aggregate particles; (x) heating the aggregate particles at temperatures of about 5° C. to about 60° C.

above the Tg of the resin, followed by a reduction of the pH to about 2.5 to about 5.5 and preferably to about 3 to about 5 with an acid to form coalesced particles of a toner composition with a smooth surface about spherical in morphology; (xi) followed by separating the particles by either filtration or centrifugation and drying the toner particles by freeze drying, fluid bed drying or spray drying; (i) forming a resin latex emulsion of a submicron resin, less than about 1 micron in diameter as measured by a Coulter Counter, particles in the absence of any surfactants by emulsion polymerization, wherein the monomers utilized are polymerizable in the presence of an water soluble initiator; (ii) preparing a second resin by solution polymerization resulting in a polymeric resin comprising, for example, styrene-butylacrylate-sodium styrene sulfonate, and which resin is prepared in the presence of an organic initiator wherein the resin obtained is then precipitated in a solvent and the resin recovered is then dispersed in warm water to provide a submicron resin dispersion; (iii) the dispersion of (ii) is then utilized to stabilize the toner colorant particles; (iv) blending the resin latex dispersion with a colorant dispersion and optionally a wax dispersion to form a resin/colorant blend; (v) adding a mixture of an inorganic cationic coagulant solution of a metal salt such as aluminum sulfate, dissolved in dilute nitric acid and a organic cationic coagulant such as dialkyl benzenealkyl ammonium chloride to the resin-colorant blend, while continuously subjecting the blend to high shear, to induce a homogeneous gel of the resin-colorant blend; (vi) heating the sheared gel at temperature of about 5° C. to about 10° C. below the resin glass transition temperature (Tg) while continuously stirring to form aggregate particles; (vii) allowing a period of aggregation time to permit stabilization of the aggregate particle size; (viii) optionally adding the above latex of (i) or to the mixture of aggregate particles; (ix) changing the pH of the mixture to be about 6.5 to about 9.0 with a base to stabilize the aggregate particles; (x) heating the aggregate particles at temperatures of about 5° C. to about 60° C. above the Tg of the resin, followed by a reduction of the pH to about 2.5 to about 5.5 and preferably to about 3 to about 5 with an acid to form coalesced toner particles; (xi) separating the toner particles by filtration or centrifugation and drying the particles by freeze drying, fluid bed drying or spray drying; optionally incorporating other toner additives, such as waxes, which can function as a release component during fusing and charge control agents, CCA, (iv), wherein the release agents, such as wax, and the charge control agents particles are stabilized with the resin dispersion of (ii); examples of waxes including those illustrated in U.S. Pat. No. 5,994,020, the disclosure of which is totally incorporated here by reference; and the preparation of a latex by emulsion polymerization wherein the resulting resin particles selected can be in embodiments styrene acrylates, styrene butadiene, styrene isoprene, styrene methacrylate and the like, optionally stabilized by organic monomers and polymers, such as sodium styrene sulfonate or other water soluble polymers.

Illustrative examples of resin particles contained in (i) and in the toner product are selected from known polymers selected from the group consisting of, for example, poly (styrene-butylacrylate), poly(styrene-butadiene), poly(para-methyl styrenebutadiene), poly(meta-methyl styrene-butadiene), poly(alpha-methyl styrene-butadiene), poly (methylmethacrylate-butadiene), poly(ethylmethacrylate-butadiene), poly(propylmethacrylate-butadiene), poly (butylmethacrylate-butadiene), poly(methylacrylate-butadiene), poly(ethylacrylate-butadiene), poly (propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethyl methacrylate-isoprene), poly (propylmethacrylate-isoprene), poly(butyl methacrylate-isoprene), poly(methylacrylate-isoprene), poly (ethylacrylate-isoprene), poly(propylacrylate-isoprene), and poly(butylacrylate-isoprene); and terpolymers such as poly (styrene-butadiene-acrylic acid), poly(styrene-butadiene-methacrylic acid), PLIOTONE available from Goodyear, polyethylene-terephthalate, polypropylene-terephthalate, polybutylene-terephthalate, polypentylene-terephthalate, polyhexalene-terephthalate, polyheptadene-terephthalate, polyoctalene-terephthalate, all containing sodium styrene sulfonate, POLYLITE (Reichhold Chemical Inc.), PLASTHALL (Rohm & Haas), CYGAL (American Cyanamid), ARMCO (Armco Composites), ARPOL (Ashland Chemical), CELANEX (Celanese Eng), RYNITE (DuPont), and STYPOL.

The second resin which primarily functions as a dispersant for the colorant particles thereby providing, for example, a stable aqueous colorant dispersion, and which second resin can be selected in an amount of, for example, from about 10 to about 30 percent by weight of water is, for example, styrene-n butylacrylate-sodium styrene sulfonate, styrene-isoprene-sodium styrene sulfonate, styrene-n butylacrylate-potassium-3-sulfopropylacrylate, styrene-isoprene-potassium-3-sulfopropylacrylate, styrene-n butylacrylate-potassium-3-sulfopropylmethacrylate, styrene-isoprene-potassium-3-sulfopropylmethacrylate, sodium styrene sulfonate, stryrene-isobutylmethacrylate-sodium styrene sulfonate, styrene-isobutylmethacrylate-potassium-3-sulfopropylacrylate. One preferred second resin is styrene-n butylacrylate-sodium styrene sulfonate, which can be prepared by solution polymerization process wherein the monomers comprise styrene, n butylacrylate, and a 4-styrene sulfonic acid sodium salt, wherein the ration of styrene to n butylacrylate is in a range amount of about 70:30 to about 88:12, and the 4-styrene sulfonic acid sodium salt is present in the range amount of about 2 to about 7 weight percent of styrene-n butylacrylate monomer.

The preparation of the second resin, such as styrene normal (n) butylacrylate-sodium styrene sulfonate, can be accomplished by solution polymerization processes, wherein the monomers are polymerized at a temperature of about 60° C. to about 80° C. in the presence of an organic initiator and the resulting polymer resin is then precipitated in an organic solvent such as methanol. This resin is then dispersed in warm water to provide an emulsion of styrene-n butylacrylate-sodium styrene sulfonate. Examples of water soluble polymers that may be selected as the second resin are styrene acrylics wherein the polymer contains greater than about 10 percent, and more specifically, from about 15 to about 50 percent of acrylic acid monomer. Water soluble polymers with functionalized end groups, such as amines, can also be selected. Optionally, a resin obtained from solution polymerization processing can be melt mixed with colorant, wherein the colorant-resin mixture can then be dispersed in warm water to obtain colorant dispersion.

The latex resin particles of (i) can be present in various effective amounts, such as from about 70 weight percent to about 98 weight and preferably between about 80 and about 92 percent of the toner, and can be of small average particle size such as from about 0.01 micron to about 1 micron in average volume diameter as measured by the Brookhaven nanosize particle analyzer. Other effective amounts of resin can be selected.

The latex resin particles of (i) selected for the process of the present invention are preferably prepared by, for example, emulsion polymerization processes, including semi-continuous emulsion polymerization methods, and the monomers utilized in such processes can be selected from, for example, styrene, acrylates, methacrylates, butadiene, isoprene, and optionally acid or basic olefinic monomers such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups in the monomer, or polymer resin is optional and such groups can be present in various amounts of from about 0.1 to about 10 percent by weight of the polymer resin. Chain transfer agents such as dodecanethiol or carbon tetrabromide, can also be selected when preparing resin particles by emulsion polymerization.

Suitable water soluble initiators include, but are not limited to ammonium persulfate, potassium persulfate, sodium persulfate, ammonium persulfite, potassium persulfite, sodium persulfite, ammonium bisulfate, potassium bisulfate, sodium bisulfate, 1,1'-azobis(I-methylbutyronitrile-3-sodium sulfonate, and 4,4'-azobis(4-cyanovaleric acid. Preferably, the initiator is a persulfate initiator such as ammonium persulfate, potassium persulfate, sodium persulfate and the like. The initiator is generally added as part of an initiator solution in water. The amount of initiator used to form the latex polymer is generally, for example, from about 0.1 to 10 weight percent of the monomer to be polymerized.

The second resin of (ii) can be prepared by a solution polymerization process using organic soluble initiators, such as hydrogen peroxide, t-butyl hydroperoxide, cumene hydroperoxide, para-methane hydroperoxide, benzoyl peroxide, tert-butyl peroxide, cumyl peroxide, 2,2'-azobisisobutyronitrile, 2,2'-azobis(2-methyl-butyonitrile, 2,2'-azobis(2-amindinopropane)dihydrochloride, 2,2'-azobisisobutyl amide dihydrate, 2,2'-azobis[2-(2-imidazoline-2-yl)propane]dihydrochloride and the like. Other processes for obtaining resin particles of from about 0.01 micron to about 1 micron in diameter are the polymer microsuspension process as illustrated in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes. The resulting resin solid content may vary from, for example, about 10 to about 60 percent and about 90 to about 40 percent water.

Examples of waxes that can be selected are polyethylene, polypropylene functionalized waxes, such as amines, and amides example like aqua Superslip 6550, Superslip 6530, a polyethylene/amide available from Micropowder Inc.; fluorinated waxes, for example, Polyfluo 190, Polyfluo 200, Polyfluo 523XF, Aqua Polyfluo 411, all polyethylene/PTFE functionalized waxes, Aqua Polysilk 19, Polysilk 14, polyethylene/PTFE/amide functionalized waxes available from Micropowders Inc., a mixed fluorinated amide wax, for example, Microspersion 19 also available from Micropowder Inc., imides, esters, quaternary amines, carboxylic acids, acrylic polymer emulsions, for example, Joncryl 74, 89,130, all available from Johnson & Son, chlorinated polypropylenes and chlorinated polyethylenes. The amount of wax that is added is, for example, in the range of about 3 to about 12 percent by weight of toner, and which wax can be added during blending of the latex and the pigment, wherein the wax added is in form of a dispersion of submicron wax particles suspended in an aqueous media.

The colorant, such as the pigment dispersion, is not particularly limited in composition or method of preparation. The colorant dispersion preferably comprises submicron pigment particles in the diameter size range of, for example, about 0.08 to about 0.2 micron and which are stabilized by, for example, submicron resin particle of styrene-n butylacrylate-sodium styrene sulfonate which are in the size range of about 0.05 to about 0.15 microns and which sulfonate acts as a dispersant for the colorant particles. Other stabilizing polymeric resins include those with functionalized groups such as carboxylic acids; sulfonates; phosphates, and the like.

In some instances, colorants are available in the wet cake or in concentrated form containing water, and which colorants can be easily dispersed utilizing a homogenizer or simply by stirring. In other instances, colorants, such as pigments, are available only in a dry form, whereby dispersion in water is effected by microfluidizing using, for example, an M-110 microfluidizer or an ultimizer, and passing the dispersion from about 1 to about 10 times through the chamber; by sonication, such as using a Branson 700 sonicator, or with a homogenizer with the addition of dispersing agents such as resin emulsion particles of styrene-butylacrylate-sodium styrene sulfonate and other known water soluble polymers. Colorant dispersions can also be generated by melt mixing or flushing of the colorant with the resin followed by dispersing in warm water to provide a stable submicron colorant dispersion.

Various known colorants present in the toner in an effective amount of, for example, from about 1 to about 25 percent by weight of the toner, and preferably in an amount of from about 2 to about 12 weight percent, that can be selected include known cyan, magenta, yellow, red, green, and blue pigments. Specific examples of pigments include phthalocyanine HELIOGEN BLUE L6900, D6840, D7080, D7020, PYLAM OIL BLUE, PYLAM OIL YELLOW, PIGMENT BLUE 1, available from Paul Uhlich & Company, Inc Pigment Blue 15.3, Pigment Red 81.3, Pigment 122, Pigment Red 238, Pigment Yellow 14, Pigment Yellow 17, Pigment Yellow 74, Pigment Green 7, Pigment Orange 16 available from Sun Chemicals PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAperm YELLOW FGL, HOSTAPERM PINK E, Pigment Yellow 180 from Clariant, and CINQUASIA MAGENTA available from E.I. DuPont de Nemours & Company, and the like. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33 2,5-dimethoxy-4-sulfonanilide phenylazo-4'-chloro-2,5-dimethoxy acetoacetanilide, and Permanent Yellow FGL. Dyes include food dyes, and other known suitable dyes.

Emulsion aggregation processes for generating toners in accordance with aspects of the present invention can utilize an ionic coagulant, such as a cationic coagulant, in an amount, for example, of from about 50 to about 80 percent (ranges provided herein refer to examples, thus other amounts may be selected) the ionic coagulant having an opposite polarity preferably a positive polarity compared to the ionic charge of the latex (i.e., a counterionic coagulant), to primarily ensure that the latex containing the anionic charge is completely aggregated into toner particles, and present to prevent or minimize the appearance of fines in the final slurry, that is, small sized particles of less than about 1 micron in average volume diameter, which fines can adversely affect toner yield.

The positive polarity counterionic coagulants which may be comprised of organic, inorganic entities or mixtures thereof usually possess an opposite polarity to the ionic charge of the resin latex dispersion. For example, the ionic charge of the resin latex dispersion can be anionic in nature due the presence of the water soluble initiator, such as a persulfate, thus the counterionic coagulant is an inorganic cationic coagulant of a metal salt, such as aluminum sulfate, and optionally an organic cationic coagulant such as a dialkyl benzenealkyl ammonium chloride. Also, the cationic charge may reside in the latex and the anionic species may then serve as the coagulant.

Examples of organic cationic coagulants include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, and the like, and mixtures thereof. The coagulant is usually present in an aqueous medium in an amount of from, for example, about 0.05 to about 10 percent by weight and preferably in the range of from about 0.075 to about 5 percent by weight of toner.

Inorganic cationic coagulants include, for example, aluminum sulfate, magnesium sulfate, zinc sulfate, potassium aluminum sulfate, calcium acetate, calcium chloride, calcium nitrate, zinc acetate, zinc nitrate, aluminum chloride, and the like. This coagulant is usually contained in an aqueous medium in an amount of from, for example, about 0.05 to about 10 percent by weight and preferably in an amount of about 0.075 to about 2 percent by weight of toner. The coagulant may also contain minor amounts of other components, for example nitric acid.

The cationic coagulant is utilized in various effective amounts as indicated herein, such as for example from about 0.05 to about 10 percent and preferably between about 0.075 and 5 percent by weight of water. The molar ratio of the cationic surfactant used for coagulation is related to the total amount of anionic surfactant used in the preparation of the resin latex dispersion and is in a range of, for example, about 0.5 to about 4, and preferably from about 0.5 to about 2.

The coagulant may comprise a mixture of an inorganic and an organic coagulant including, for example, mixtures of aluminum sulfate and dialkyl benzenealkyl ammonium chloride, potassium aluminum sulfate and dialkyl benzenealkyl ammonium chloride, wherein the ratio amount thereof is in the range of about 25:75 to about 75:25 of the inorganic and organic coagulant. Mixtures of coagulants are usually used in an aqueous medium, each coagulant being present in an amount of from, for example, about 0.05 percent to about 2 percent by weight.

The coagulant is preferably added slowly over a period of about 0.5 minute to about 30 minutes, and more specifically, over a period of about 1 to about 10 minutes into the blend while continuously subjecting the resulting blend to high shear, for example, by stirring with a blade at about 3,000 to about 10,000 rpm, and more specifically, about 5,000 rpm, for about 1 to about 120 minutes. A high shearing device, for example an intense homogenization device, such as the in-line IKA SD-41, may be used to ensure that the blend is homogeneous and uniformly dispersed.

Following homogenization, aggregation of the homogenized composition is effected by heating the composition to a temperature below the glass transition temperature (Tg) of the resin of the latex while agitating the composition. The temperature of the heating is from, for example, about 5° C. to about 10° C. below the Tg of the resin. The agitation preferably comprises continuously stirring the mixture using a mechanical stirrer at between, for example, about 200 to about 800 rpm. The aggregation is conducted for a period of time until the aggregate particle size is stabilized, which may be for from, for example, about 10 minutes to about 6 hours. Additional coagulants, such as organic cationic coagulants like dialkyl benzenealkyl ammonium chloride, may be optionally added should the particle size distribution be greater than about 1.25 and the fines coated be greater than about 3 percent.

The resulting particles are then coalesced by changing the pH of the aggregate composition from an initial pH of about 2.5 to a pH greater than or equal to about 5.5, or more specifically, to about 6 to about 8, with the addition of a base, to stabilize the aggregates from further growth, followed by heating at a temperature above the Tg of the resin in the toner particles. More specifically, the heating for coalescing is conducted at a temperature of from about 5° C. to about 40° C., preferably about 10° C. to about 30° C., above the Tg of the resin, which heating is accomplished for a period of about 30 minutes to about 5 hours.

Prior to the coalescence, the pH of the aggregate composition, which is initially, for example, in the range of about 2 to about 3, may be and preferably is changed to a pH of, for example, about 6 to about 8 with a suitable pH increasing agent, such as for example an alkali metal hydroxide like sodium hydroxide. The increase in the pH stabilizes the aggregates particles and prevents or minimizes further particle size growth and degradation of the particle size distribution during further heating, for example, raising the temperature 5° C. to 40° C. above the resin Tg. After about 15 to about 60 minutes at the coalescence temperature, the pH is then gradually decreased to about 3 to about 5, wherein this reduction in pH permits coalescence the fusion of the aggregates. The preferred pH reducing agents include, for example, nitric acid, citric acid, sulfuric acid or hydrochloric acid, and the likes.

The preparation of a surfactant free latex by emulsion polymerization, and wherein the resulting latex is stable, that is it does not degrade, for example, or decompose, over a period of 2 weeks to 6 months, which latex is aggregated with a pigment dispersion and optionally a wax dispersion, both which are also surfactant free with the addition of a coagulant followed by coalescence, pigmented particles, and optionally wherein the majority of the latex, about 60 to about 90 percent thereof is added at the initiation of the aggregation coalescence, and the about 20 to about 40 percent of the remainder optional latex (the delayed latex) can be added after the formation of the resin-colorant aggregates of (vii), wherein homogenization ensures the rapid formation of particles with narrow geometric size distribution (GSD), for example less than 1.25, and wherein lack of homogenization may result in the formation of large sized aggregates, for example a particle larger than 20 microns, and wherein following addition of the coagulant, the delayed latex can then be added to form a shell of latex of the toner particles, and wherein the particles may also be washed with, for example, hot water, and dried such as by use of an Aeromatic fluid bed dryer.

The toner generated can also include known charge additives in effective amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, the disclosures of which are totally incorporated herein by reference, and the like. Surface additives that can be added to the toner compositions after washing or drying include, for example, metal salts, metal salts of fatty acids, colloidal silicas, metal oxides, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972® available from Degussa in amounts of from 0.1 to 2 percent which can be added during the aggregation process or blended into the formed toner product.

Developer compositions can be prepared by mixing the toners obtained with the process of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration.

The toner particles generated preferably have an average volume diameter of from about 0.5 to about 25, and preferably from 1 to about 10 microns, and a narrow GSD characteristic of from about 1.05 to about 1.25, and preferably of from 1.15 to 1.25 as measured by a Coulter Counter. The toner particles also have an excellent shape factor, for example, of 120 or less wherein the shape factor is considered a measure of smoothness and roundness, where a shape factor of 100 is considered perfectly spherical and smooth, while a shape factor of 140 is considered to be rough in surface morphology and the shape thereof is like a potato as measured by a microscope. The resulting toners can be selected for known electrophotographic imaging and printing processes, including color processes, and lithography.

The following Examples illustrate embodiments and advantages of the present invention. Parts and percentages are by weight unless otherwise indicated.

EXAMPLES

Latex Preparation:

A latex was prepared with 40 weight percent monomer loading, weight ratio of 79/21 weight percent of St/BA (styrene butyl acrylate) and which contained 1.5 percent of acrylic acid monomer. The latex preparation was performed in the following manner. To the organic phase comprised of 500 grams of styrene, 133 grams of butyl acrylate, 9.5 grams of acrylic acid was added 7.9 grams (1.25 weight percent by weight of monomer) of dodecanethiol-DDT (a chain transfer agent) and mixed. Separately, there was prepared an aqueous phase comprised of 950 grams of deionized water to which 7.9 grams of ammonium persulfate (initiator) and 3.2 grams of 4-styrene sulfonic acid, sodium salt was added and mixed (mixture A). The aqueous phase was then charged into a 2 liter buchi reactor and heated to 70° C. with stirring, and the organic phase of mixture A was then slowly added to the aqueous phase over a period of three hours. The resulting emulsified phase was then held at a temperature of 70° C. (degrees Centigrade) for a period of 2 hours to conduct the emulsion polymerization. The reactor was then cooled down to room temperature, about 25° C. throughout, and the physical properties of the latex comprised of styrene-butylacrylate-acrylic acid-sodium styrene sulfonate resin particles in water were measured resulting in a resin particle size of 150 nanometers with a $M_w$ of 30,000 and a Tg of 57.5° C. The composition of the latex was 79 parts styrene, 21 parts butylacrylate, 1.5 pph of acrylic acid, and 0.5 pph of sodium styrene sulfonate.

Preparation of Second Resin:

Preparation of a Terpolymer Polystyrene Polybutyl Acrylate and Poly-4-Styrene Sulfonic Acid, Sodium Salt:

To a two liter reactor equipped with a mechanical stirrer, condenser and nitrogen inlet tube, were added 700 grams of toluene. To this was added an organic mixture of 246 grams of styrene, 54 grams of butyl acrylate, 9 grams of 4-styrenesulfonic acid, sodium salt, 12 grams of dodecanethiol and 2 grams of benzoyl peroxide. The resulting monomer mixture was then polymerized at 70° C. for six hours. The polymer was then isolated by precipitation of the polymer into 5 liters of methanol to yield a terpolymer of polystyrene polybutyl acrylate and poly-4-styrene sulfonic acid, sodium salt; the Tg of the polymer was 59° C. as measured by DSC and which polymer possessed an $M_w$ of 34,000 and $M_n$ 9,800 as measured by water's GPC.

Preparation of Pigment Dispersion:

30 Grams of the above second resin were slowly added to 270 grams of preheated 70° C. water while continuously being stirred until the added resin was fully dispersed resulting in a whitish tinge dispersion (resin dispersion B) with a particle size of 90 nanometers as measured by the Nicomp Particle analyzer; 90 grams of Process Blue 15.3 dry pigment were then added to 210 grams of the resin dispersion B and ground in a media mill until the pigment was broken down into submicron particles. The pigment dispersion prepared comprised 30 percent of pigment, 10 percent of the second prepared resin as a coating on the pigment and 60 percent of water. The pigment dispersion obtained did not settle out over a period of 90 days indicating it was stable.

Other Pigment Dispersion Preparation:

Similarly, other pigments like Process Red 81.3, Yellow 14, and lack REGAL 330® dispersion were also prepared by repeating the above rocess.

TONER PREPARATION

Example I

Yellow Toner:

To 310 grams of the above latex of 40 percent solids comprised of styrene/butylacrylate/sodium styrene sulfonate submicron resin particles of 150 nanometers in size suspended in a 60 percent aqueous (water) media were simultaneously added with 100 grams of a dilute pigment dispersion comprised of 40 grams of Yellow 14 pigment stabilized by sodium styrene sulfonate submicron particles (30 percent pigment and 10 percent sulfonated polyester) and 60 grams of water, to 400 grams of water, while being polytroned at 3,000 RPM. Ten (10) grams of an aqueous acidified inorganic cationic coagulant of aluminum sulfate solution containing 2 grams of aluminum sulfate, 7.5 grams of water and 0.5 gram of 0.5 percent nitric acid, pH=2.5 were added to the above latex-pigment mixture. 2 grams of an organic cationic coagulant of dialkyl benzenealkyl ammonium chloride in 10 grams of water were then added and the resulting mixture was polytroned for a period of 2 minutes at speeds of 5,000 rpm. The mixture was then transferred into a reaction kettle and heated to 54° C. for a period of 160 minutes where the particle size as measured on a Coulter Counter was 6 microns with a GSD of 1.20. The pH of the slurry was then adjusted from a pH of 2.5 to a pH of 7.5 with the addition of a 4 percent aqueous NaOH solution. The temperature of the reaction kettle was raised to 85° C. and held there for 30 minutes. The aggregate particle size measured was 5.9 microns with a GSD of 1.20. The temperature of the reactor was then further raised to 90 degrees and held there for 30 minutes resulting in a particle size of 5.9 microns and a GSD of 1.20. The pH of the reaction mixture was then slowly educed down to 4.8 with 5 percent dilute nitric acid. An additional 100 minutes at 90° C. resulted in smooth toner particles with a toner shape factor of 120 as measured by a scanning electron microscope (a shape factor of 100 is considered to be perfectly spherical with a very smooth surface). The toner particle size after cooling the reactor contents was found to be 5.9 microns with a GSD of 1.21. The toner was comprised of 87.5 percent of resin (i), 4.0 percent of resin (ii), and 8.5 percent of Yellow 14 pigment.

Example II

To 310 grams of the above latex comprising styrene/butylacrylate/sodium styrene sulfonate submicron resin particles suspended in an aqueous media were simultaneously added with 100 grams of a dilute pigment dispersion comprising 20 grams of P.B. 15.3 cyan pigment stabilized by sodium styrene sulfonate submicron particles (30 percent of pigment and 10 percent of sulfonated polyester) and 80 grams of water, to 400 grams of water, while being polytroned at 3,000 RPM. 10 Grams of an aqueous acidified inorganic cationic coagulant of aluminum sulfate solution containing 2 grams of aluminum sulfate, 7.5 grams of water and 0.5 gram of 0.5 percent nitric acid, pH=2.5 was added to the above latex-pigment mixture. 2 Grams of an organic cationic coagulant of dialkyl benzenealkyl ammonium chloride in 10 grams of water were then added, and the resulting mixture was polytroned for a period of 2 minutes at speeds of 5,000 rpm. The mixture was then transferred into a reaction kettle and heated to 55° C. for a period of 140 minutes where the particle size as measured on a Coulter Counter was 6.2 microns and the GSD was 1.21. The pH of the slurry was then adjusted from a pH of 2.5 to a pH of 7.5 with the addition of a 4 percent aqueous NaOH solution. The temperature of the reaction kettle was increased to 85° C. and held there for 30 minutes. The size measured particle size was 6 microns with a GSD of 1.20. The temperature of the reactor was further raised to 90° C. and held there for 30 minutes resulting in a particle size of 6 microns and a GSD of 1.21. The pH of the reaction mixture was then slowly reduced down to 4.8 with 5 percent dilute nitric acid. An additional 110 minutes at 90° C. resulted in smooth toner particles with a toner shape factor of 120 as measured by a scanning electron microscope (a shape factor of 100 is considered to be perfectly spherical with a very smooth surface). The toner particle size after cooling the reactor contents was found to be 6.1 microns with a GSD of 1.21. The toner was comprised of 93.5 percent of resin (i), 2 percent of (ii) and 4.5 percent of the above P.B 15.3 cyan pigment.

Example III

Magenta Toner:

To 310 grams of the above latex comprising styrene/butylacrylate/sodium styrene sulfonate submicron resin particle suspended in an aqueous media were simultaneously added with 100 grams of dilute pigment dispersion comprised of 25 grams of P.R. 81.3 pigment stabilized by sodium styrene sulfonate submicron particles (30 percent of pigment and 10 percent of sulfonated polyester) and 75 grams of water, to 400 grams of water, while being polytroned at 3,000 RPM. 10 Grams of an aqueous acidified inorganic cationic coagulant of aluminum sulfate solution containing 2 grams of aluminum sulfate, 7.5 grams of water and 0.5 gram of 0.5 percent nitric acid, pH=2.5 were added to the above latex-pigment mixture. 2 Grams of an organic cationic coagulant of dialkyl benzenealkyl ammonium chloride in 10 grams of water were then added and the resulting mixture was polytroned for a period of 2 minutes at speeds of 5,000 rpm. The mixture was then transferred into a reaction kettle and heated to 54° C. for a period of 160 minutes where the particle size as measured on a Coulter Counter was 6.1 microns with a GSD of 1.18. The pH of the slurry was then adjusted from a pH of 2.5 to a pH of 7.5 with the addition of 4 percent aqueous NaOH solution. The temperature of the reaction kettle was raised to 85° C. and held there for 30 minutes. The particle size measured was 6 microns with a GSD of 1.19. The temperature of the reactor was further raised to 90° C. and held there for 30 minutes resulting in a particle size of 6 microns and a GSD of 1.18. The pH of the reaction mixture was then slowly reduced down to 4.8 with 5 percent dilute nitric acid. An additional 120 minutes at 90° C. resulted in smooth toner particles where the toner shape factor was considered to be 120. The toner particle size after cooling the reactor content was found to be 6.1 microns with a GSD of 1.19. The toner was comprised of 92 percent of resin (i), 2.5 percent of resin (ii), and 5.5 percent of P.R. 81.3 pigment.

Example IV

Black Toner:

To 310 grams of the above latex comprising styrene/butyl acrylate/sodium styrene sulfonate submicron resin particle suspended in an aqueous media were simultaneously added with 100 grams of dilute pigment dispersion comprised of 35 grams of carbon black REGAL 330® pigment stabilized by sodium styrene sulfonate submicron particles (30 percent of pigment and 10 percent of sulfonated polyester) and 65 grams of water, to 400 grams of water, while being polytroned at 3,000 RPM. 10 Grams of an aqueous acidified inorganic cationic coagulant of aluminum sulfate solution containing 2 grams of aluminum sulfate, 7.5 grams of water and 0.5 gram of 0.5 percent nitric acid, pH=2.5 were added to the above latex-pigment mixture. 2 Grams of an organic cationic coagulant of dialkyl benzenealkyl ammonium chloride in 10 grams of water were then added and polytroned for a period of 2 minutes at speeds of 5,000 rpm. The mixture was then transferred into a reaction kettle and heated to 55° C. for a period of 160 minutes where the particle size as measured on a Coulter Counter was 6.3 microns with a GSD of 1.19. The pH of the slurry was then adjusted from a pH of 2.5 to a pH of 7.5 with the addition of a 4 percent aqueous NaOH solution. The temperature of the reaction kettle was raised to 85° C. and held there for 30 minutes. The particle size measured was 6.4 microns with a GSD of 1.19. The temperature of the reactor was further raised to 90° C. and held there for 30 minutes resulting in a particle size of 6.4 microns and a GSD of 1.19. The pH of the reaction mixture was then slowly reduced down to 4.8 with 5 percent dilute nitric acid. An additional 140 minutes at 90° C. resulted in smooth toner particles wherein the toner shape factor was considered to be 120. The particle size after cooling the reactor contents was found to be 6.4 microns with a GSD of 1.20. The toner was comprised of 88.9 percent of resin (i), 3.5 percent of resin (ii), and 7.6 percent of the above REGAL 330® carbon black pigment.

Other embodiments and modifications of the present invention may occur to those of ordinary skill in the art subsequent to a review of the present application and the information presented herein; these embodiments, modifications, and equivalents, or substantial equivalents thereof, are also included within the scope of the present invention.

What is claimed is:

1. A process for the preparation of toner comprising (i) generating by emulsion polymerization in the presence of an initiator a first resin latex emulsion;

(ii) generating by solution polymerization in the presence of an oil soluble initiator a second resin latex;

(iii) mixing (ii) with a colorant thereby providing a colorant dispersion;

(iiib) mixing the resin latex emulsion of (i) with the resin/colorant mixture of (iii) to provide a blend of resin and colorant;

(iv) adding an inorganic cationic coagulant solution of a metal salt, an organic cationic coagulant solution or mixtures thereof to the resin/colorant blend of (iiib);

(v) heating at a temperature of from about 5° C. to about 10° C. below the latex resin Tg of (i) to form aggregate particles, and which particles are at a pH of from about 2 to about 4;

(vi) adjusting the pH of (v) to about 6.5 to about 9 by the addition of a base;

(vii) heating the aggregate particles at a temperature of from about 5° C. to about 50° C. above the Tg of the latex resin of (i), followed by a reduction of the pH to from about 2.5 to about 5 by the addition of an acid thereby resulting in coalesced toner; and (viii) optionally isolating the toner.

2. A process in accordance with claim 1 wherein subsequent to (vi) there is added an additional latex containing a resin generated by emulsion polymerization.

3. A process in accordance with claim 2 wherein subsequent to the addition of said latex there is formed a coating on the aggregates of (v).

4. A process in accordance with claim 1 (ii) wherein the resulting resin is dispersed in warm water resulting in a resin dispersion which dispersion is then added to said colorant, and mixed thereby providing a colorant dispersion.

5. A process in accordance with claim 1 wherein (iv) is accomplished by stirring and then subjecting the blend to high shear to form a homogeneous gel.

6. A process in accordance with claim 1 wherein the toner is isolated, and optionally washed and dried, and wherein the toner is comprised of resin and colorant.

7. A process for the preparation of a toner comprising (i) generating by emulsion polymerization in the presence of an initiator a latex emulsion containing a first resin;

(ii) generating by solution polymerization a second resin, and optionally wherein the resulting resin is dispersed in warm water to provide a dispersion of the second resin;

(iii) mixing (ii) and a colorant wherein there is formed a coating of resin (ii) on said colorant thereby providing a stable colorant dispersion, and wherein optionally from about 70 to about 95 percent of colorant is coated by said resin;

(iv) blending the resin latex emulsion of (i) with the colorant/resin dispersion (iii) to form a resin latex/colorant blend;

(v) adding an aqueous inorganic cationic coagulant solution of a metal salt, an organic cationic coagulant or mixtures thereof to the resin latex/colorant blend (iv), while optionally continuously subjecting the blend to high shear to optionally induce the formation of a homogeneous gel of the resin/colorant blend;

(vi) heating the sheared gel of (v) at a temperature of from about 5° C. to about 10° C. below the latex resin (i) glass transition temperature optionally while continuously stirring to form aggregate particles of resin, coagulant and colorant;

(vii) optionally retaining (vi) for an optional period of from about 1 to about 3 hours to primarily minimize growth of the aggregates and optionally achieving a narrow GSD of from about 1.15 to about 1.24;

(viii) optionally adding a further latex comprised of resin (i), wherein the addition of said latex enables the formation of a coating on said aggregates of (vii);

(ix) changing the pH of said aggregates of (vii) which is initially in the range of from about 2 to about 3.5 to a pH in the range of about 6.5 to about 9 by the addition of a base to thereby primarily stabilize the aggregate particles from further growth;

(x) heating the aggregate particles of (ix) at temperatures of from about 5° C. to about 50° C. above the Tg of the resin (i), followed by a reduction of the pH from the range of about 6.5 to about 9.0 to a pH range of about 2.5 to about 5 with an acid to form coalesced particles of a toner composition of resin (i), resin (ii), resin (viii) and colorant; and (xi) optionally separating and drying the toner.

8. A process in accordance with claim 7 wherein said resin (i) is submicron in size and wherein said submicron is from about 50 to about 250 nanometers in diameter; said warm is from about 60° C. to about 80° C.; said resin of (ii) is dispersed in warm water resulting in a resin dispersion with resin particle size in the range of about 30 to about 120 nanometers in diameter and wherein the dispersion of (ii) is selected as dispersant for the colorant particles to provide a stable colorant dispersion by grinding said colorant particles in the resin dispersion (ii) resulting in a colorant dispersion comprising colorant particles with a resin coating in water, and wherein the coating thickness of said second resin (iii) is from about 10 to about 120 nanometers, the coating thickness of said additional latex resin (viii) after the formation of the aggregates is in the range of from about 0.1 (100 nanometers) to about 1 (1,000 nanometers) micron; and wherein the components of the final toner are comprised of (a) a resin latex of (i), (b) resin (ii), (c) resin (viii), and (d) colorant, with the following optional amount ranges of (a) about 53.5 to about 65.6 percent;

(b) about 4 to about 15 percent;

(c) about 0.4 to about 1.5 percent;

(d) from about 1 to about 15 percent, and wherein the total of said toner components (a) to (d) is about 100 percent.

9. A process in accordance with claim 7 wherein the latex of (i) comprises submicron resin particles of styrene, butylacrylate, and sodium styrene sulfonate, which sulfonate optionally functions as a dispersant for said resin, thereby providing a stable latex.

10. A process in accordance with claim 7 wherein the pH during the blending and the aggregation (iv) to (viii) is in the range of about 1.8 to about 4.5.

11. A process in accordance with claim 7 (iv) to (vi), wherein the pH is acidic and the pH is the range of from about 1.8 to about 4 enabling a narrow particle size distribution for said toner aggregates of (vi), and wherein the size distribution thereof is in the range of from about 1.16 to about 1.24.

12. A process in accordance with claim 7 wherein the latex (vii) is comprised of the same polymer resin composition as that of (i) or a different polymer composition than that of (i) and/or a polymer with different molecular properties of weight average molecular weight, number molecular number, molecular weight distribution, and glass transition temperature (Tg) than that of (i), thereby providing a toner core shell structure.

13. A process in accordance with claim 7 wherein the second resin (ii) prepared by solution polymerization provides a resin which is dispersible in warm water wherein the temperature of said water is in the range of from about 60° C. to about 80° C. thereby providing a stable emulsion containing water and submicron size resin particles which are in the size range diameter of from about 0.03 to about 0.12 micron.

14. A process in accordance with claim 7 wherein the inorganic cationic coagulant is selected from the group consisting of metal sulfates, metal nitrates, and metal chlorides.

15. A process in accordance with claim 14 wherein said coagulant is aluminum sulfate, magnesium sulfate, zinc sulfate, potassium aluminum sulfate, calcium acetate, calcium chloride, calcium nitrate, zinc acetate, zinc nitrate, or aluminum chloride.

16. A process in accordance with claim 7 wherein the organic cationic coagulant is an organic salt of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, or dodecylbenzyl triethyl ammonium chloride.

17. A process in accordance with claim 7 wherein (iv) further includes adding a wax dispersion comprised of submicron wax particles in the size range of about 80 to about 200 nanometers, which are optionally stabilized by the resin of (ii), and wherein the wax particles contain a coating of the resin of (ii).

18. A process in accordance with claim 17 wherein the wax is selected from the group consisting of polyethylene, polypropylene, polyethylene/amide, polyethylene tetrafluoroethylene, and polyethylene tertraflouorethylene/amide.

19. A process in accordance with claim 1 wherein the second resin (ii) is prepared in the presence of an organic initiator and wherein said resin is selected from a group consisting of a terpolymer of styrene butylacrylate 4-styrene sulfonic acid sodium salt, styrene butylacrylate-4-styrene phosphoric acid sodium salt and styrene acrylic acid polymers.

20. A process in accordance with claim 1 wherein the latex of (i) contains a resin selected from a group consisting of poly(styrene-acrylate), poly(styrene-butadiene), poly (para-methyl styrene-butadiene), poly(meta-methyl styrene-butadiene), poly(alpha-methylstyrene-butadiene), poly (methyl methacrylate-butadiene), poly(ethylmethacrylate-butadiene), poly(propyl methacrylate-butadiene), poly (butylmethacrylate-butadiene), poly(methyl acrylate-butadiene), poly(ethylacrylate-butadiene), poly (propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly (propylmethacrylate-isoprene), poly(butylmethacrylate-isoprene), poly(methylacrylate-isoprene), poly (ethylacrylate-isoprene), poly(propylacrylate-isoprene), and poly(butylacrylate-isoprene) copolymers.

21. A process in accordance with claim 1 wherein the heating in (vi) is at a temperature of from 5° C. to 10° C. below the glass transition temperature (Tg) of the latex emulsion resin of (i), further including stirring the mixture resulting at speeds of about 200 and about 800 rpm to form aggregates of a diameter of from about 3 to about 10 microns with a narrow GSD in the range of from about 1.10 to about 1.25, or wherein the heating in (x) is conducted at a temperature of from about 5° C. to about 50° C. above the glass transition temperature (Tg) of the resin of (i) to form a toner comprised of styrene-butylacrylate-sodium styrene sulfonate and a colorant in the size range of about 3 to about 10 microns wherein the latex resin dispersion of (i) contains submicron resin particles having an average size diameter of about 250 nanometers or less, wherein the high shear in (v) is from 3,000 to 10,0000 rpm for 1 to about 120 minutes; the high (v) is performed by a homogenizer, or a microfluidizer.

22. A process in accordance with claim 1 wherein the toner obtained possesses an average volume diameter of from about 1 to about 20 microns.

23. A process in accordance with claim 7 wherein for the preparation of the latex (i) the initiator is ammonium persulfate, potassium persulfate, sodium persulfate, ammonium persulfite, potassium persulfite, sodium persulfite, ammonium bisulfate, potassium bisulfate, sodium bisulfate, 1,1'-azobis(I-methylbutyronitrile-3-sodium sulfonate, or 4,4'-azobis(4-cyanovaleric), and which initiator is selected in the amount of about 0.1 to about 10 weight percent of the monomer to be polymerized, and wherein the oil soluble initiator for the preparation of the second latex (ii) is hydrogen peroxide, t-butyl hydroperoxide, cumene hydroperoxide, paramethane hydroperoxide, benzoyl peroxide, tert-butyl peroxide, cumyl peroxide, 2,2'-azobisisobutyronitrile, 2,2'-azobis(2-methyl-butyonitrile, 2,2'-azobis(2-amindino propane)dihydrochloride, 2,2-azobisisobutyl amide dihydrate, 2,2'-azobis[2-(2-imidazoline-2-yl)propane]dihydrochloride, and which initiator is present in an amount of about 0.1 to about 10 weight percent of the monomer to be polymerized in (ii).

24. A process in accordance with claim 4 wherein the resin or resins of (ii) forms a coating on the colorant particles thereby providing a stable colorant.

25. A process in accordance with claim 1 wherein an organic cationic is selected.

26. A process in accordance with claim 1 wherein the inorganic cationic coagulant is selected from the group consisting of metal sulfates, metal nitrates, and metal chlorides; and the organic cationic coagulant is an organic salt of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, and dodecylbenzyl triethyl ammonium chloride.

27. A toner process which comprises mixing a colorant, a resin latex (i), a resin latex (ii), and an inorganic coagulant, an organic cationic coagulant, or mixtures thereof; heating below the resin latex (i) glass transition temperature; and heating above the latex resin (i) glass transition temperature.

28. A process in accordance with claim 27 wherein (i) is generated by emulsion polymerization, (ii) is generated by solution polymerization; the heating below is accomplished at a pH of from about 2 to about 4, and the resin of (ii) forms a shell or coating on said resin (i), and said colorant.

29. A process in accordance with claim 27 wherein an organic coagulant is selected.

30. A process in accordance with claim 27 wherein an inorganic coagulant is selected.

31. A process in accordance with claim 27 wherein the inorganic cationic coagulant is selected from the group consisting of metal sulfates, metal nitrates, and metal chlorides; and the organic cationic coagulant is an organic salt of dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, and dodecylbenzyl triethyl ammonium chloride.

* * * * *